US007654856B2

(12) United States Patent
Wu

(10) Patent No.: US 7,654,856 B2
(45) Date of Patent: Feb. 2, 2010

(54) CABLE CONNECTOR ASSEMBLY HAVING STRAIN RELIEF MEMBER FOR CABLE

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/284,205

(22) Filed: Sep. 19, 2008

(65) Prior Publication Data

US 2009/0298339 A1 Dec. 3, 2009

Related U.S. Application Data

(63) Continuation-in-part of application No. 12/154,739, filed on May 27, 2008.

(51) Int. Cl.
*H01R 13/58* (2006.01)

(52) U.S. Cl. ..... 439/460; 439/607.45

(58) Field of Classification Search ..... 439/607.52, 439/607.45, 465, 470
See application file for complete search history.

(56) References Cited

U.S. PATENT DOCUMENTS 4,861,284 A * 8/1989 Pauza et al. ..... 439/580
5,961,351 A * 10/1999 Wu ..... 439/607.45
6,663,415 B1 12/2003 Wu
6,706,970 B2 3/2004 Laub
7,247,046 B1 7/2007 Wu
7,306,479 B1 12/2007 Wu

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

A cable connector assembly (100) in accordance with the present invention includes a metal housing (1), a terminal assembly (2) and a metal sleeve (5). The metal housing includes a mating port (11), a soldering port (12) with an opening in the center thereof and a passage formed through the mating and soldering ports. The terminal assembly is received in the passage of the metal housing and includes mating and soldering portions (21, 22) which are electrically insulated from the metal housing, the soldering portion exposed in the mating port of the metal housing, the soldering portion extending through the opening of the soldering port to be exposed by the metal housing and adapted to be soldered to a cable (3). The metal sleeve encloses a solder joint (8) between the cable and the soldering portion of the terminal assembly, a front portion (6) of the metal sleeve extends into and is soldered to the opening of the metal housing, and a rear portion of the metal sleeve engages with the cable.

19 Claims, 9 Drawing Sheets

CABLE CONNECTOR ASSEMBLY HAVING STRAIN RELIEF MEMBER FOR CABLE

CROSS-REFERENCE TO RELATED APPLICATIONS

This application is a C-I-P (Continuation-in-Part Application) of U.S. patent application Ser. No. 12/154,739 filed on May 27, 2008 and entitled "CABLE CONNECTOR ASSEMBLY HAVING STRAIN RELIEF MEMBER FOR CABLE", which has the same applicant and assignee as the present invention.

BACKGROUND OF THE INVENTION

1. Field of the Invention

The present invention generally relates to a cable connector assembly, and more particularly to a cable connector assembly having a strain relief member for a cable.

2. Description of Related Art

Metal strain relief member is widely used in a cable connector assembly for providing mechanical support and grounding function to a cable. Usually, there are two types of strain relief member currently. One type is that a conductive shell forms a train relief section grasping a metal braiding layer of a cable to provide mechanical support and grounding function. The other type is that a cable connector assembly has a separate strain relief member comprising a strain relief section grasping a metal braiding layer of the cable and electrically connects with a metal shell of the cable connector assembly to realize mechanical support and grounding function, such as disclosed in U.S. Pat. Nos. 6,706,970B2, 6,663,415B1.

BRIEF SUMMARY OF THE INVENTION

An object of the present invention is to provide a cable connector assembly having a stain relief member with thereof a sleeve for enclosing contact junctions between a cable and terminals.

In order to achieve the above-mentioned object, a cable connector assembly in accordance with the present invention comprises a metal housing, a terminal assembly and a metal sleeve. The metal housing includes a mating port, a soldering port with an opening in the center thereof and a passage formed through the mating and soldering ports. The terminal assembly is received in the passage of the metal housing and includes mating and soldering portions which are electrically insulated from the metal housing, the soldering portion exposed in the mating port of the metal housing, the soldering portion extending through the opening of the soldering port to be exposed by the metal housing and adapted to be soldered to a cable. The metal sleeve encloses a solder joint between the cable and the soldering portion of the terminal assembly, a front portion of the metal sleeve extends into and is soldered to the opening of the metal housing, and a rear portion of the metal sleeve engages with the cable.

Other objects, advantages and novel features of the invention will become more apparent from the following detailed description of the present embodiment when taken in conjunction with the accompanying drawings.

DETAILED DESCRIPTION OF THE INVENTION

Figure 1:
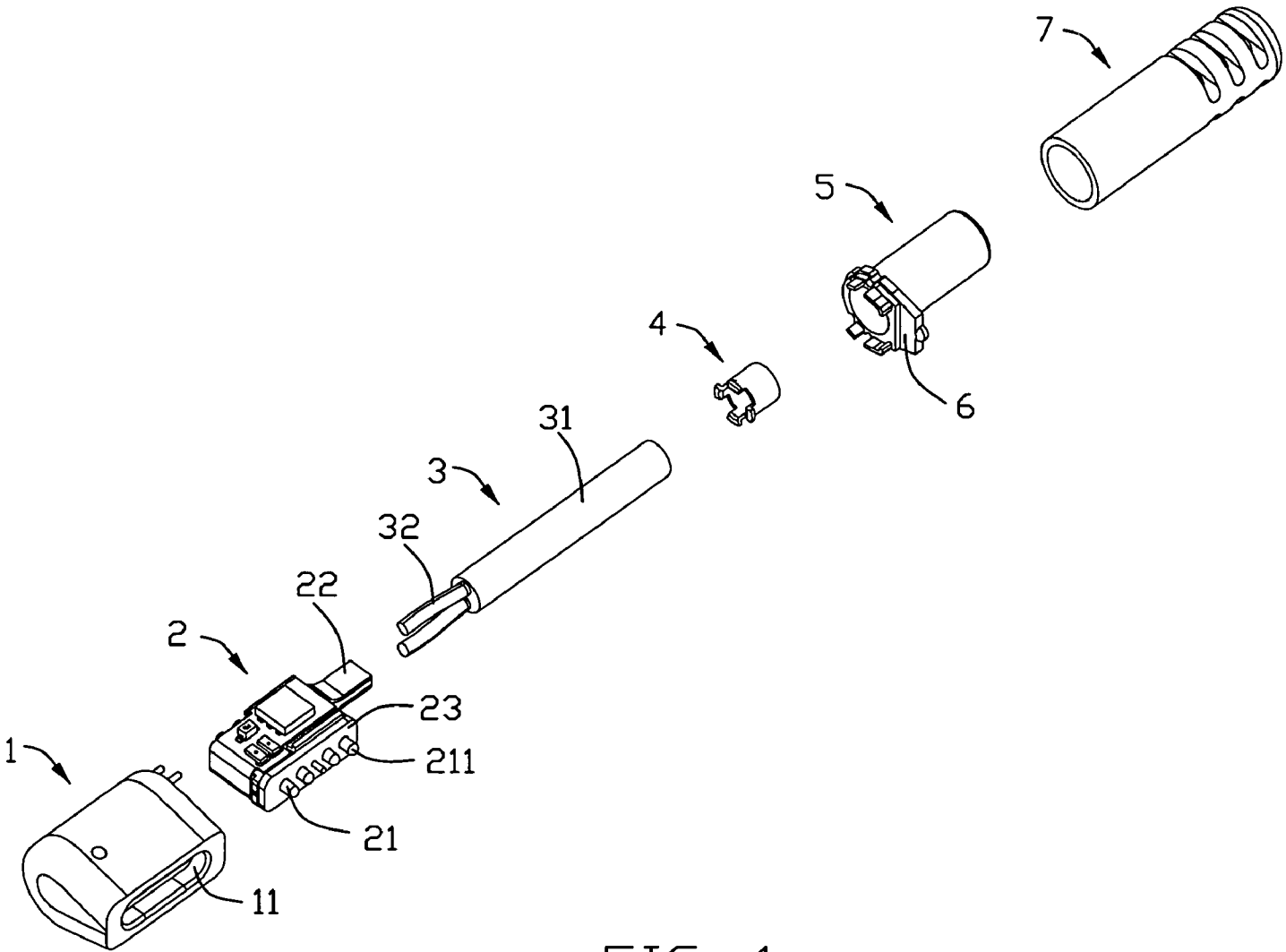
FIG. 1 is an exploded, perspective view of a cable connector assembly in accordance with the first embodiment of the present invention.

Reference will now be made to the drawing figures to describe the present invention in detail.

Figure 2:
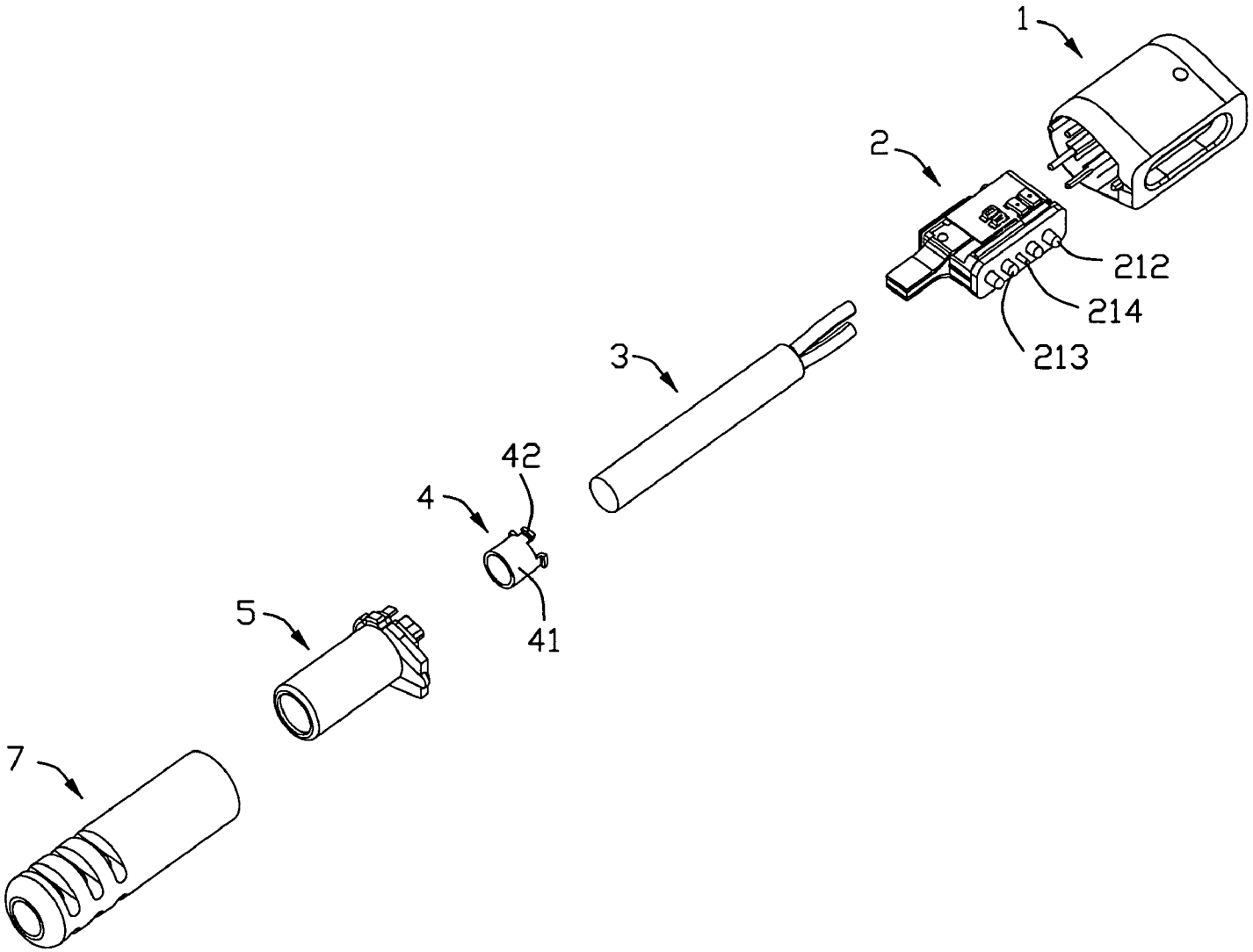
FIG. 2 is a view similar to FIG. 1, but viewed from a different aspect.
Figure 3:
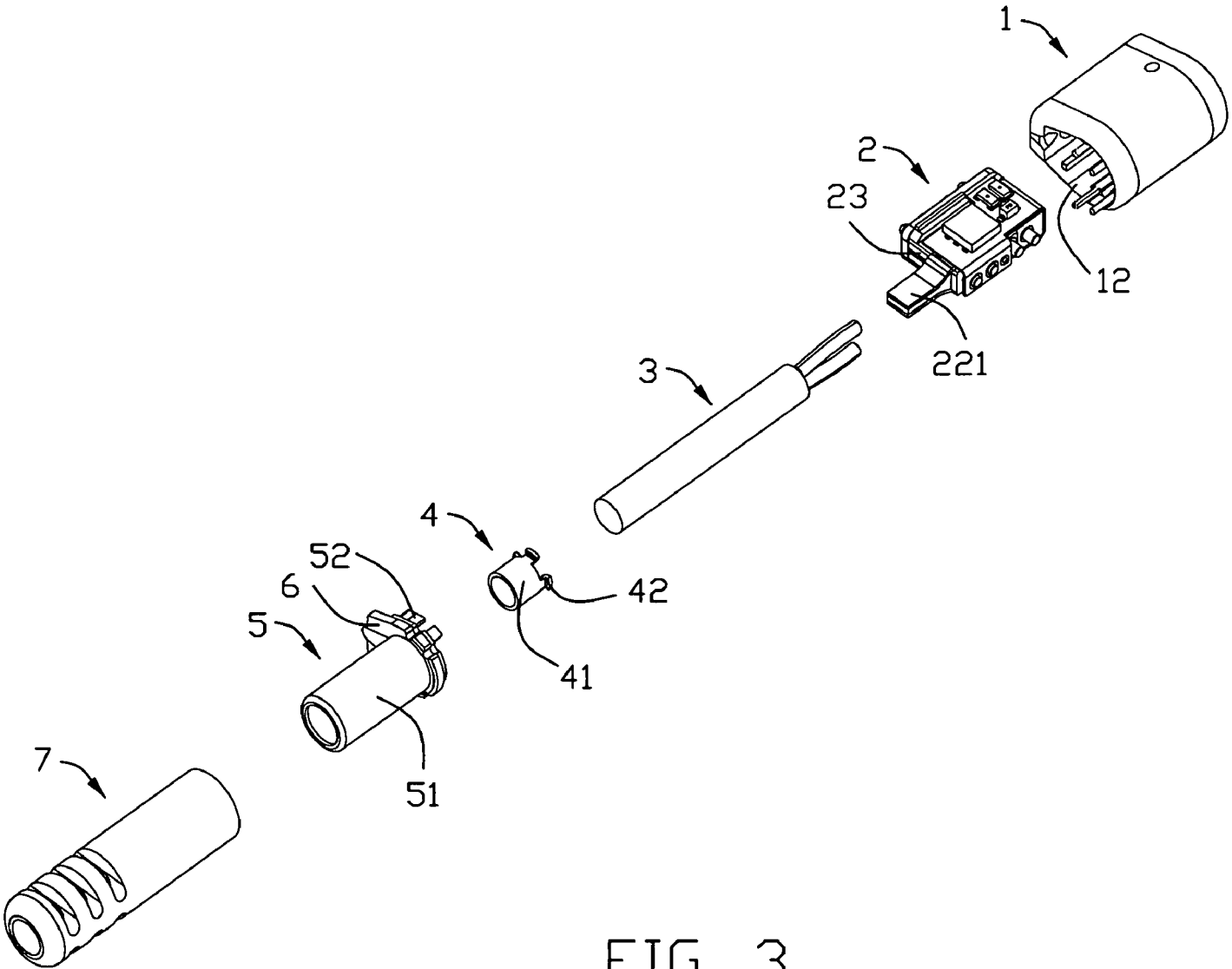
FIG. 3 is a view similar to FIG. 1, but viewed from another different aspect.
Figure 4:
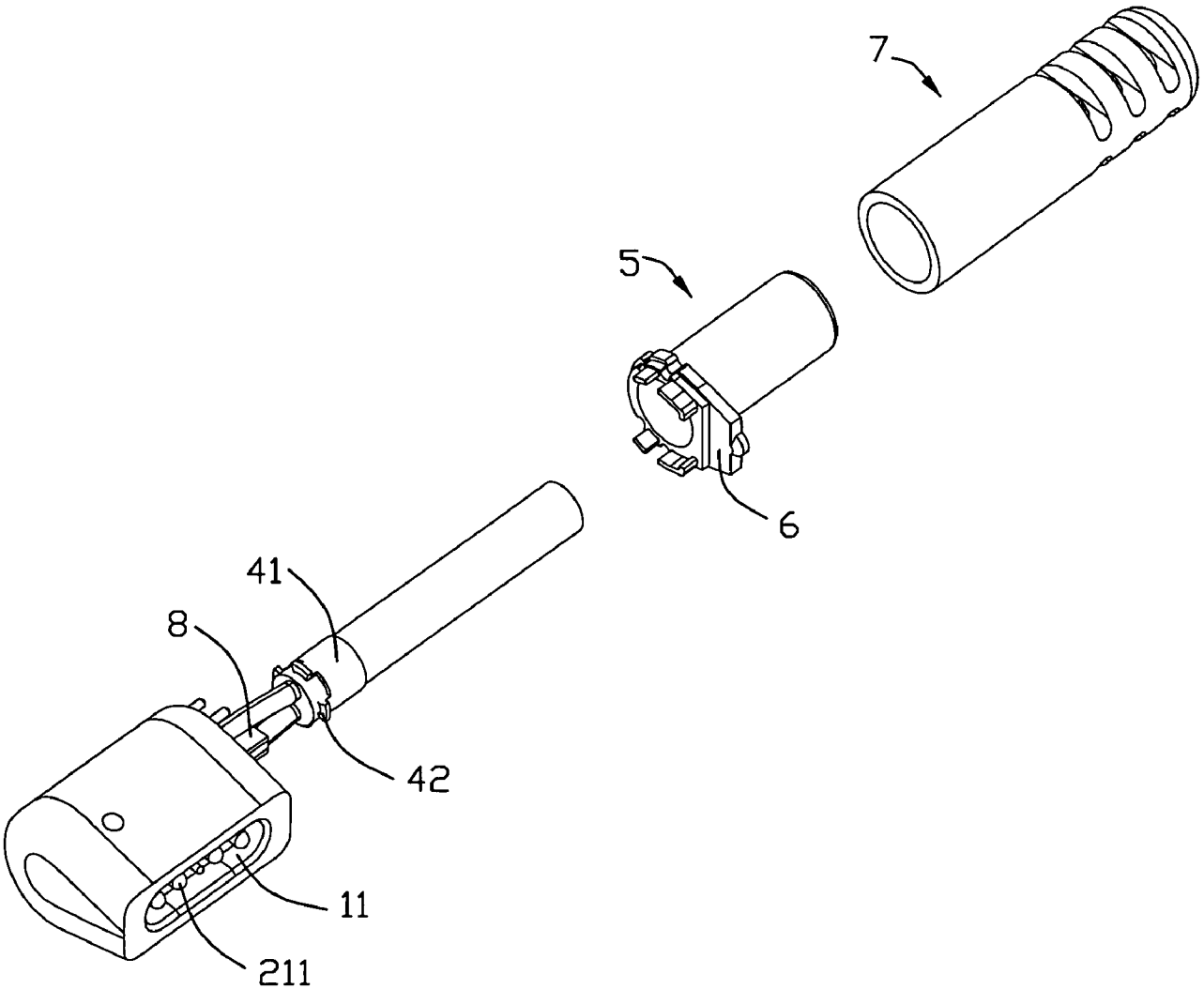
FIGS. 4-7 show assembling process of the cable connector assembly.
Figure 5:
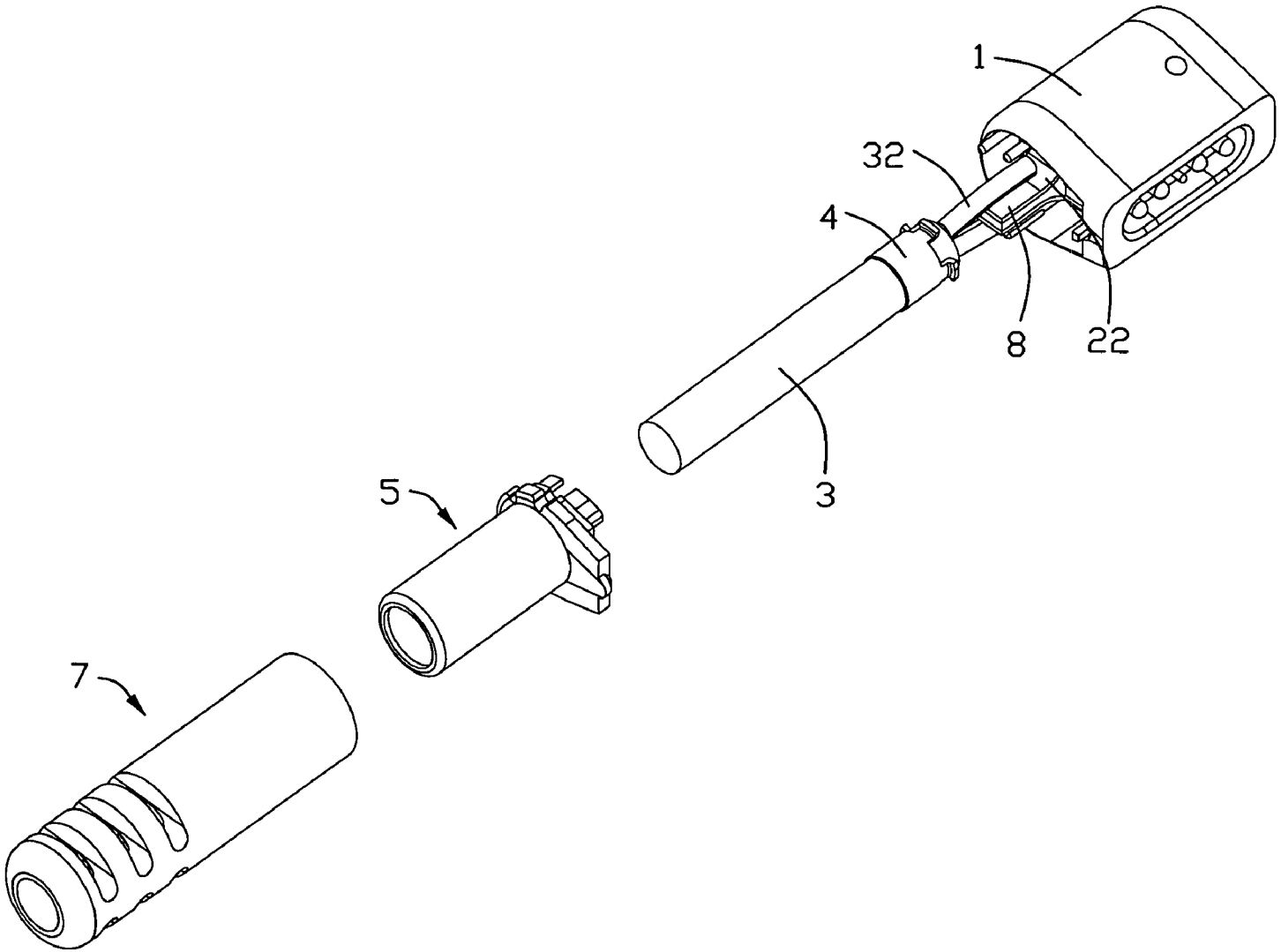
Figure 6:
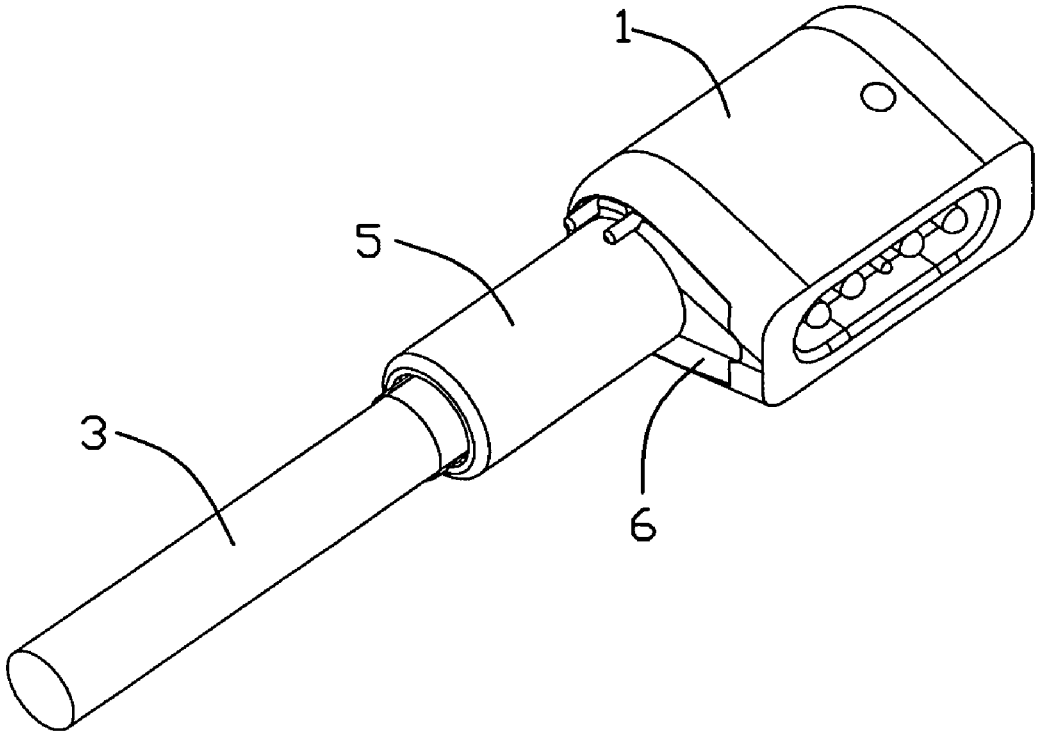
Figure 7:
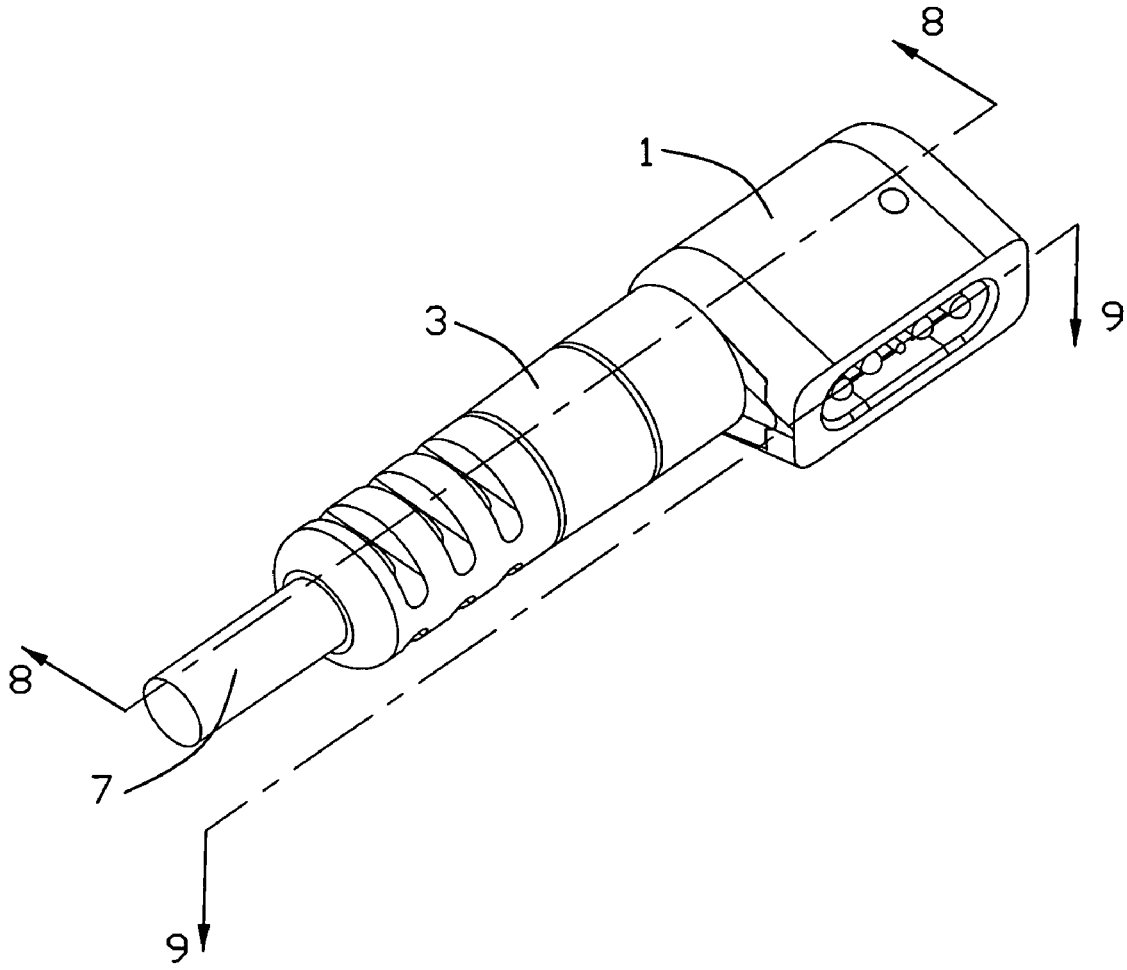
Figure 8:
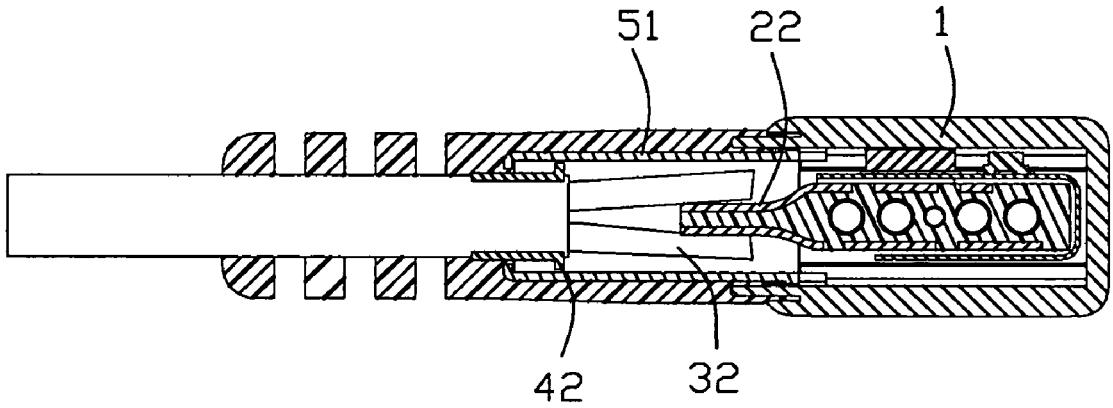
FIGS. 8-9 are cross-section views taken along lines 8-8 to 9-9 of FIG. 7.
Figure 9:
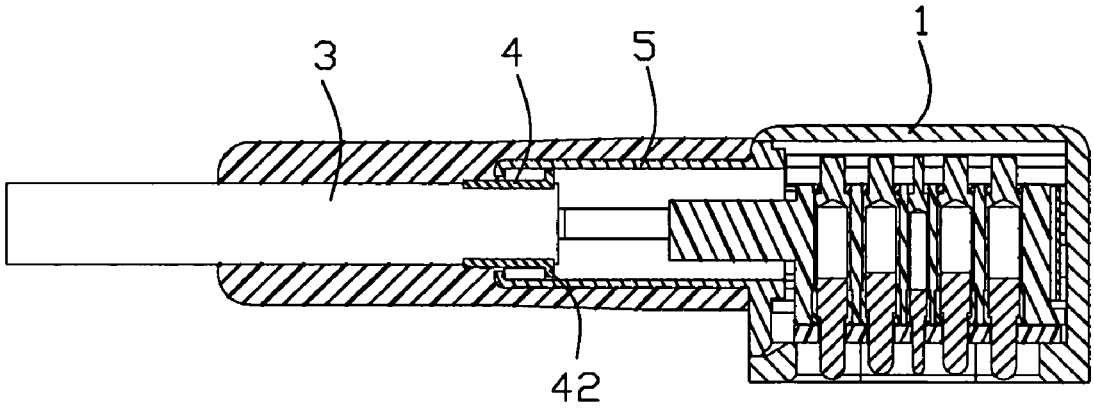

Referring to FIGS. 1-3, a cable connector assembly 100 in accordance with the present invention comprises a housing 1, a terminal assembly 2 assembled to the housing 1, a round cable 3 soldered to the terminal assembly 2, a rigid sleeve 5 covering a contact junction 8 between the terminal assembly 2 and the round cable 3, and a strain relief member 7 molded over the rigid sleeve 5 and a part of the round cable 3.

The housing 1 is made of metal and comprises a mating port 11 opening to the left so as to mate with a complementary connector and a soldering port 12 opening to the rear so as to accommodate the round cable 4. The mating port 11 and the soldering port 12 communicate with each other and receive the terminal assembly 2 therein.

The terminal assembly 2 comprises a terminal block 23, five mating members 21 held in the terminal block 23, a plurality of function elements 24 held on surfaces of the terminal block 23 and electrically connecting with the mating members 21, and a pair of soldering members 22 electrically connecting with the function elements 24. The mating members 21 is received in the terminal block 23, with front portions 211 of the mating members 21 extending beyond the terminal block 23 so as to mate with a complementary connector. Tail portions 221 of the soldering members 22 extends beyond the terminal block 23 and the housing 1 so as to be soldered to the round cable 3.

The mating members 21 consist of a pair of ground terminals 212, a pair of power terminals 213 located between the pair of ground terminals 212 and a center detect terminal 214 located between the pair of power terminals 213. Each mating member 21 is of a POGO Pin type, that is to say, there is a spring (not shown) inside the mating member 21, thus, when mating, the mating member 21 can be pressed to rearward move along the mating direction. One of the pair of soldering members 22 electrically connects with the pair of power terminals 213 for transmitting positive electricity, and the other electrically connects with the pair of ground terminals 212 for transmitting negative electricity.

The round cable 3 comprises an insulative jacket 31 at the outermost thereof and a pair of conductive conductors 32 enclosed by the insulative jacket 31 for transmitting power. A front portion of the insulative jacket 31 is stripped to expose part of the conductive conductors 32.

A cable clamp 4 which is made of metal is mounted on the cable 3, and comprises a tubular crimper 41 mounted and crimped on outer surfaces of the round cable 3 and a hook 42 holding the sleeve 5.

The rigid sleeve 5 is made of metal and comprises a tube 51 covering the contact junctions 8 between the round cable 3 and the soldering members 22, an enlargement 52 extending forwards into the opening 12 of the housing 1 and holding on the housing 1, and a side plate 6 engages with the opening 12 to seal up the opening 12.

In assembly, please referring to FIGS. 4-9, at first the cable clamp 4 is inserted from the front into the tube 51 of the sleeve 5 with the tubular crimper 41 extending beyond the sleeve 5 and exposed outside. Then the front portion of the round cable 3 is inserted into the sleeve 5 with the conductive conductors in the front exposed outside the sleeve 5. Thirdly, solder the conductive conductors to the soldering members 22. Fourthly, the sleeve 5 slides along the round cable 3 so that the tube 51 covers the contact junctions 8 and the enlargement 52 enters into the opening 12 of the housing 1 and the side plate 6 engages with and seals up the opening 12 of the housing 1 to prevent the enlargement 52 from withdrawing from the opening 12. Fifthly, press the tubular crimper 41 inwards so the cable clamp 4 holds on the round cable 3. The housing 1, the side plate 6, the rigid sleeve 5 and the cable clamp 4 are soldered to each other. Finally, the strain relief member 7 is molded over a part of the round cable 3 and the rigid sleeve 5.

The sleeve 5 is mounted to cover the contact junction 8 between the round cable 3 and the soldering member 22 so that the contact junction 8 isn't destroyed when the strain relief member 7 is molded. Moreover, the sleeve 5 is rigid and can strengthen the rigidity of the round cable 3.

Other structures and assembly process of the cable connector assembly 200 same as those of the cable connector assembly 100 are omitted here.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a metal housing comprising a mating port, a soldering port and a passage formed through the mating and soldering ports, said soldering port defining an opening in the center thereof;

a terminal assembly received in said passage of the metal housing, the terminal assembly comprising mating and soldering portions which are electrically insulated from the metal housing, said soldering portion exposed in the mating port of the metal housing, said soldering portion extending through said opening of the soldering port to be exposed by the metal housing and adapted to be soldered to a cable; and a metal sleeve enclosing a solder joint between the cable and said soldering portion of the terminal assembly, a front portion of the metal sleeve extending into and soldered to said opening of the metal housing, a rear portion of the metal sleeve engaging with the cable.

2. The cable connector assembly as claimed in claim 1, wherein the metal sleeve comprises a side plate in the front thereof, the side plate engages with and is soldered to the opening of the metal housing.

3. The cable connector assembly as claimed in claim 2, wherein the side plate is shaped to near perfect match with the opening of the metal housing.

4. The cable connector assembly as claimed in claim 2, wherein the side plate is formed integrally with the metal sleeve.

5. The cable connector assembly as claimed in claim 4, wherein the side plate is shaped to near perfect match with the opening of the metal housing.

6. The cable connector assembly as claimed in claim 5, wherein a cable clamp is mounted on the cable, and comprises a tubular crimper grasping an outer surface of the cable and a hook holding the sleeve.

7. The cable connector assembly as claimed in claim 6, wherein a strain relief member is molded over the metal sleeve and a part of the cable.

8. The cable connector assembly as claimed in claim 1, wherein a strain relief member is molded over the metal sleeve and a part of the cable.

9. The cable connector assembly as claimed in claim 1, wherein a cable clamp is mounted on the cable, and comprises a tubular crimper grasping an outer surface of the cable and a hook holding the sleeve.

10. The cable connector assembly as claimed in claim 1, wherein the terminal assembly comprises a pair of soldering portions, one of which electrically connects at least two mating portions for transmitting positive electricity, the other of which electrically connects at least two mating portions for transmitting negative electricity.

11. A power connector assembly, comprising:

a housing comprising a mating port which extends along a mating direction and a soldering port which extends perpendicularly to the mating direction, the mating port defining an opening at the center thereof;

a terminal assembly received in the housing, the terminal assembly comprising a plurality of mating members which extend into the mating port of the housing and a pair of soldering members which electrically connect with the mating members and extend through the opening of the housing so as to be soldered to a cable;

a sleeve mounted to cover a solder joint between the cable and the soldering member of the terminal assembly, the sleeve extending forwards into the opening of the housing so as to be held on the housing, the sleeve extending backwards to hold the cable; and a strain relief member is molded over the sleeve and a part of the cable.

12. The power connector assembly as claimed in claim 11, wherein a cable clamp is mounted on the cable, and comprises a tubular crimper mounted and crimped on outer surfaces of the cable and a hook holding the sleeve.

13. The power connector assembly as claimed in claim 11, wherein the sleeve comprises a side plate in the front thereof, the side plate engages with and is soldered to the opening of the housing.

14. The power connector assembly as claimed in claim 13, wherein the side plate is shaped to near perfect match with the opening of the housing.

15. The power connector assembly as claimed in claim 13, wherein the side plate is formed integrally with the sleeve.

16. A power connector assembly comprising:

a metallic hollow housing having a connector receiving opening and a cable extending opening on different sides thereof;

a terminal module disposed in the housing and including an insulator with a plurality of associated contact units having mating portions exposed in the connector receiving opening and cable connection portions exposed in the connector receiving opening;

a cable including a plurality of wires connected to the corresponding cable connection portions, respectively;

a metallic cable clamp surrounding and grasping an exterior surface of the cable; and a metallic sleeve enclosing a connection area of said wires and the corresponding connection portions with thereof a rear end mechanically and electrically engaged with the cable clamp and a front end mechanically and electrically engaged with the housing.

17. The power connector assembly as claimed in claim 16, wherein a plastic strain member directly encloses the sleeve and a portion of an exterior surface of the cable and further connects to the housing.

18. The power connector assembly as claimed in claim 16, wherein said connector receiving opening and said cable extending opening are perpendicular to each other.

19. The power connector assembly as claimed in claim 16, further including an inner printed circuit board sub-assembly with a plurality of electronic components thereon, said sub-assembly being sandwiched between the housing and the terminal module in a transverse direction perpendicular to a front-to-back direction along which said cable extends.

* * * * *